United States Patent [19]

Blanchard et al.

[11] Patent Number: 4,744,496

[45] Date of Patent: May 17, 1988

[54] WRAPAROUND SKIRT AND SLACK HANGER WITH ANCHOR FINGERS

[75] Inventors: Russell O. Blanchard, Zeeland; John H. Batts, Grand Rapids, both of Mich.

[73] Assignee: Batts, Inc., Zeeland, Mich.

[21] Appl. No.: 28,152

[22] Filed: Mar. 26, 1987

[51] Int. Cl.[4] ..... A47G 25/30; A47G 25/36

[52] U.S. Cl. ..... 223/95; D6/315

[58] Field of Search ..... 223/88, 95, 85, 61, 223/63, 87; D6/315, 326, 327

[56] References Cited

U.S. PATENT DOCUMENTS

| | | | |
|---|---|---|---|
| D. 159,944 | 9/1950 | Austensen | D6/326 |
| 2,164,525 | 7/1939 | Keys | 223/95 X |
| 2,829,810 | 4/1958 | Wilson | 223/88 |
| 3,007,616 | 11/1961 | Zuckerman | 223/89 |
| 3,249,270 | 5/1966 | Zuckerman | 223/91 |
| 3,266,685 | 8/1966 | Eskenazi | 223/95 |
| 3,317,096 | 5/1967 | Bissonnette | 223/95 |
| 3,406,882 | 10/1968 | Phillips | D6/315 X |
| 3,469,679 | 9/1969 | Kamins et al. | D6/315 X |
| 3,547,321 | 12/1970 | Crane | 223/88 |
| 4,703,878 | 11/1987 | Louw | 223/95 |

*Primary Examiner*—Robert R. Mackey

*Attorney, Agent, or Firm*—Price, Heneveld, Cooper, DeWitt & Litton

[57] ABSTRACT

A hanger for garments with a waistband having at least a limited degree of stretchability has a compression resistant body with dependent end members having garment gripping end faces. Between the end members, the hanger body has a plurality of dependent fingers arranged in two groups, one on each side of the center of the hanger body. The fingers are arranged at spacings to accommodate a variety of garment sizes, the waistbands of which are wrapped around both ends of the hanger and anchored to a selected pair of the fingers. In a modified construction, the fingers are hinged so they can be pivoted out of the plane of the hanger body to facilitate mounting and removal of the garments.

4 Claims, 1 Drawing Sheet

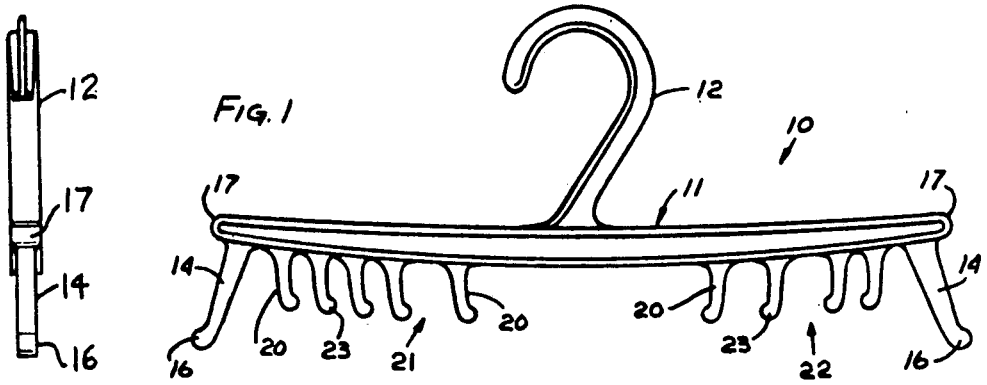
FIG. 1
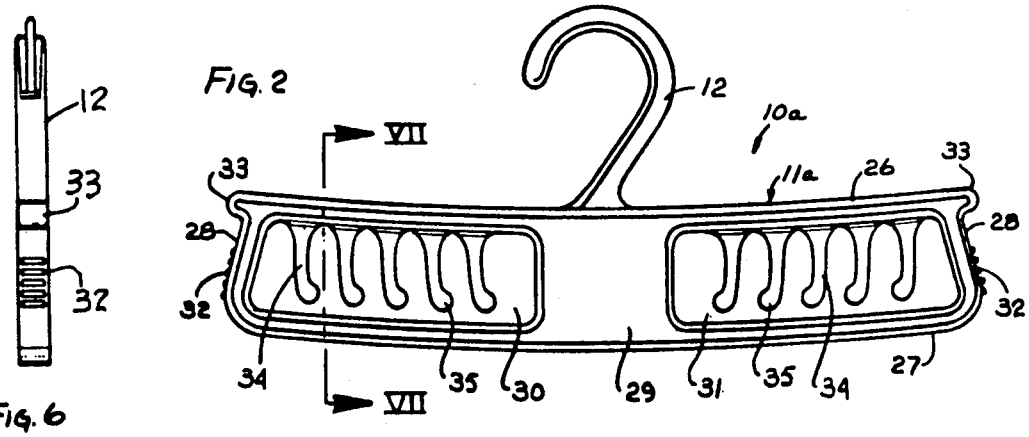
FIG. 2
FIG. 5
FIG. 6
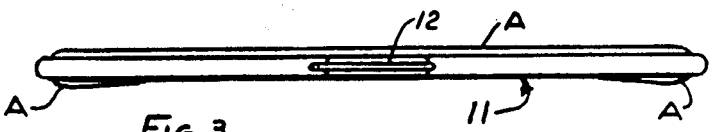
FIG. 3
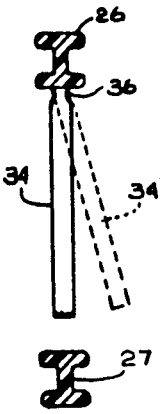
FIG. 7
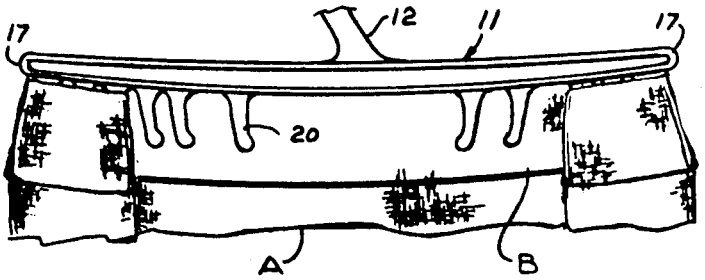
FIG. 4

WRAPAROUND SKIRT AND SLACK HANGER WITH ANCHOR FINGERS

FIELD OF THE INVENTION

This invention relates to hangers used for either display or shipping of garments or both and, particularly, for hangers having a stretchable waistband.

BACKGROUND OF THE INVENTION

The most extensive use of garment hangers today is for shipping and for display of the garments at the point of purchase. Such garment hangers must be capable of positively supporting the garment during both shipping and while it is being displayed. The hangers must also be so designed that the garments, as displayed, are attractive and displayed to their best advantage. Also the hanger must not leave any unattractive marks or impressions on the garment.

It is also very important that the hangers add a minimum of bulk to the garment, particularly during shipping. This is also true in many retail facilities where display space is at a premium. Thus, they should be compact and light weight, yet strong enough to support the weight of the garment even during rough handling. The hanger must be easy to use and not require any complex manipulation. In other words, it must be user friendly. It is also important that the cost be held to a minimum because this type of hanger is normally a "one way shipper", that is, it is seldom returned to the garment manufacturer.

It is also true that, as the field of clothes manufacturing and merchandising becomes more competitive, garment hangers are becoming more specialized, that is, suitable for use on only one type or, at most, only a few types of garments. This invention provides a hanger of this type, particularly designed for the shipment and display of garments, the top of which has a waistband.

BRIEF DESCRIPTION OF THE INVENTION

The hanger of this invention has an elongated body formed by a rigid beam of molded plastic which beam is supported at the center by a hook. The hook may be molded integrally with the body or a separate component rotatably attached to the body. At each end, the body has a downwardly extending end member over which the waistband of a garment may be hooked or around which the end of the waistband can be wrapped.

This hanger can be used with non-stretchable waistbands but is particularly useful for garments having a stretchable one such as certain shorts, swim suits, slacks and the like.

The hanger is provided with ends designed to prevent garment slippage and release from the hanger and means to accommodate garments having a variety of waistband lengths. Thus, with a garment having a stretchable waistband, the garment can be so secured to the hanger that it is stretched only enough to effect positive support for the garment without requiring the waistband to be so stretched that it would result in a permanent set of the elastic in the waistband. These and other characteristics of garment hangers using this invention will be made clear by the following drawings and the accompanying description thereof.

BRIEF DESCRIPTION OF THE DRAWINGS

FIG. 1 is a side elevation view of a hanger incorporating this invention;

FIG. 2 is a side elevation view of a modified construction for the hanger;

FIG. 3 is a top plan view of either of the hangers illustrated in FIGS. 1 or 2 with the hanger loaded with a garment;

FIG. 4 is a fragmentary rear view of the hanger illustrated in FIG. 1 after it has been loaded with a garment;

FIG. 5 is an end view of the hanger illustrated in FIG. 1;

FIG. 6 is an end view of the hanger illustrated in FIG. 2; and

FIG. 7 is a sectional elevation view taken along the plane VII—VII of FIG. 2.

DESCRIPTION OF THE PREFERRED EMBODIMENT

The hanger 10 of this invention, as illustrated in FIG. 1, has a body 11 with an integral hook 12 midway between its ends. The hook could also be a separate element and could be rotatably secured to the body. The body has an elongated rigid beam element 13 of generally I-beam cross section. At its outer ends, end members 14 depend from the beam element. The end members extend downwardly and are outwardly inclined. At their lower ends, each has an outwardly protruding smoothly rounded garment grip 16. At the upper end of the end members 14, the beam element projects a short distance beyond the end members to form a garment stop 17. The beam element, hook and end members are all molded as a single, integral structure from a suitable plastic material such as polypropolyene or styrene. It is important that the design of the beam element be capable of withstanding limited compressive loads without flexing and, thus, forming a bow which would result in shortening the effective length of the body 11.

Depending from the lower face of the beam element are a plurality of fingers 20, preferably arranged in two groups adjacent opposite ends of the hanger. Thus, most of the fingers 20 in group 21 are spaced apart a shorter distance than the fingers 20 in group 22. The purpose of this will be made clear subsequently.

The fingers are all identical, each being integral with the beam element 13 and extending down from it and each being inclined inwardly, that is away from the adjacent end member 14. Each finger has a smoothly rounded garment gripping projection 23 at its lower end which extends in the same direction as the finger is inclined. Preferably, but not necessarily, the length of the fingers 20 is less than that of the end members 14.

To use the hanger, a garment A having a waistband B is secured to the hanger body by engaging one of the fingers 20 of one of the groups 21 or 22 inside the waistband of the garment, then wrapping the garment around the adjacent end member 14, across the opposite or front face of the body 11 and then wrapping it around the opposite end member and extending it along the same or rear face of the body from which it originally started and hooking the opposite end of the waistband over one of the fingers of the other group (FIGS. 3 and 4). Assuming the waistband to be stretchable, the finger of the second group chosen to secure the garment will be one which requires just enough tensioning of the waistband to establish a firm grip between the fingers and end members and the garment. It is important that the waistband not be so stretched that the elastic of the waistband takes a permanent set. This is a significant consideration because the garments may remain hanging on the hangers for several weeks, resulting in deterioration of the elastic, especially rubber.

The spacing arrangement of the fingers 20 is designed to accommodate a wide variety of sizes using a single hanger. Thus, a single hanger, by various combinations of the effective wraparound spacing between the fingers could accommodate all the sizes from 4 to 20. In addition, by having a different spacing of the fingers in groups 21 and 22, the hanger can be made to accommodate half sizes without excessive stretching and yet maintaining an effective grip on the garment. It will be recognized that a greater or lesser number of fingers could be provided, depending upon the degree of versatility one desires to incorporate into the hanger.

It will be recognized that hanger body 10 could be used for garments too small to be wrapped around both ends. In this case, one end of the waistband is hooked over one of the end members and the other end is wrapped around the other of the end members and then hooked to one of the fingers 20. The hanger 10 could be modified for specifically this type of use by eliminating one of the finger groups 21 or 22.

FIGS. 2 and 6 illustrate a hanger 10*a* having a modified construction for the invention. In this construction, the body 11a has upper and lower spaced, rigid beam elements 26 and 27 joined at the ends by end membes 28 and at the center by a panel 29. On each side of the panel 29, the body 11a has openings 30 and 31. The end members 28 are inclined outwardly and downwardly and their outer faces have shallow, rounded gripping teeth 32. The upper beam element 26 projects beyond both end members to form garment stops 33. The hanger is supported at its center by a hook 12.

Extending down into each of the openings from the upper beam element 26 are a plurality of fingers 34. Each finger is inclined away from its adjacent end member toward the center of the hanger body. Also each finger, at its lower end, has a rounded protrusion serving as a garment grip 35. The ends of the fingers are spaced from the lower beam element 27.

The fingers are each integral with the upper beam element and, preferably, at their juncture with that element having an area of reduced cross section forming a hinge 36 (FIG. 7). The thickness of the area forming the hinge is such that the hinge flexes stiffly, resisting bending, and permits only a small degree of deflection as illustrated in FIG. 7. This deflection, however, is enough to allow the waistband of a garment to be seated over the finger without undue obstruction from the lower beam element 27. Because of the necessity for flexing at the hinge, this particular hanger will be molded of polypropolyene.

The hanger 10*a* is used in the same manner as the hanger 10 with the garment being held flat against one face of the hanger and the ends of the waistband wrapped around the end members and secured to selected ones of the fingers, depending upon garment size (FIG. 3). Again, it will be recognized that the hanger is primarily designed for use with garments having an elastic type waistband. While the spacing of the fingers of hanger 10*a* is illustrated as being uniform, the fingers could be arranged in basically the same manner as those of the hanger 10. However, hanger 10*a* is designed for heavier garments with the hanger having greater resistance to the compressive loads necessary to hang garments of a greater weight requiring more tension and, thus, compression loading of the hanger body to assure an adequate grip. Such garments will have waistbands capable for more stretch than the lighter garments for which the hanger 10 is designed.

In the case of both the hangers 10 and 10*a*, the body has a longitudinal concave curvature with the hook supporting the body at the center of this curvature. This construction has the desirable effect of offsetting hanger distortion by heavy garments. Thus, if the weight of a garment suspended from the hanger starts to pull the ends of the hanger down, the effective length of the hanger body will thereby increase the tension and thus the grip applied to the garment. This is important in preventing unintentional garment release, particularly during transport. The hinged finger construction could be applied to hanger 10, but since that hanger does not have a bottom beam element, it is not essential, as in the case of hanger 10*a*.

The panel 29 of hanger 10*a* could be eliminated. However, since the hanger is designed for heavier garments, this would require increasing the size and rigidity of the upper and lower beam elements. It will also be recognized that the use of the lower beam element could be applied to hanger body 10 but, so long as this hanger is limited to lighter garments, such is not considered necessary and would make the hanger less convenient to use.

It will be understood that this invention provides a simple, compact and effective hanger for transporting and displaying garments, the waistbands of which are capable of some, although it may be limited, stretch to permit both loading and retention on the hanger. Because the construction is simple, relatively thin and non-bulky, it is particularly suited to use with a wide variety of garments at a very low cost per hanger.

Having described a preferred embodiment of the hanger together with several modifications of it, it will be recognized that other modifications can be made without departing from the principles of the invention. Such modifications are to be considered as included in the hereinafter appended claims, unless these claims, by their language, expressly state otherwise.

We claim:

1. A garment hanger having an elongated body, hook means for supporting said body midway between the ends thereof, said body having a depending end member at each end, said end members each having an outwardly facing garment engaging end surface shaped to resist downward sliding movement of a garment pulled around said members to press the garment against said end surfaces; a plurality of spaced fingers integral with and depending from said body intermediate said end members, said fingers being arranged in two groups, one on each side of the longitudinal center of said body, each of said fingers having a garment engaging and gripping surface directed and inclined toward the center of the hanger and away from the adjacent end of the hanger, whereby a selected pair of said fingers, one from each group, can grip and hold the stretched waistband of a garment which extends lengthwise along one face of said hanger and is wrapped firmly around both end members; the spacing between the fingers in one of the groups being different from that in the other of the groups and is such as to accommodate both full sizes and half sizes without waistband stretching which will result in permanent set of the plastic; and means spaced from the lower ends of the fingers joining said end members.

2. A garment hanger having an elongated body, said body having upper and lower beam elements; hook means for supporting said body midway between the ends thereof, said body having a depending end member at each end, said end members each having an outwardly facing garment engaging end surface shaped to resist downward sliding movement of a garment pulled around said members to press the garment against said end surfaces; the lower ends of said end members being joined by said lower beam element; means joining said beam elements at the center of said body, a plurality of spaced fingers integral with and depending from said body intermediate said end members, said fingers being arranged in two groups, one on each side of said joining means, the ends of said fingers being spaced from said lower beam element, each of said fingers having a garment engaging and gripping surface directed toward the center of the hanger, whereby a selected pair of said fingers, one from each group, can grip and hold the stretched waistband of a garment which extends lengthwise along one face of said hanger and is wrapped firmly around both end members.

3. A garment hanger as described in claim 2 wherein each of said fingers at its juncture with said upper beam element is provided with hinge means permitting the finger limited pivotal motion out of the plane of the hanger body to facilitate securing the end of a garment waistband on the finger.

4. A garment hanger as described in claim 3 wherein said hinge means is an area of reduced cross section of the finger, said area providing positive resistance to pivotal movement of the finger.

* * * * *